United States Patent [19]

Van Der Velden

[11] Patent Number: 4,781,136

[45] Date of Patent: Nov. 1, 1988

[54] SAFETY COCKPIT FOR POWERBOAT

[76] Inventor: Cornelius W. M. Van Der Velden, Halderheiweg 14, Boxtel, Netherlands

[21] Appl. No.: 858,453

[22] Filed: May 1, 1986

[51] Int. Cl.[4] ..... B63B 1/02

[52] U.S. Cl. ..... 114/56; 114/61; 114/357

[58] Field of Search ..... 114/56, 57, 61, 123, 114/258, 259, 343, 352, 357, 270

[56] References Cited

U.S. PATENT DOCUMENTS

| | | | |
|---|---|---|---|
| 3,139,058 | 6/1964 | Robinson | 114/61 |
| 3,538,877 | 11/1970 | Moore | 114/61 |
| 3,659,546 | 5/1972 | Miklos | 114/259 |
| 3,726,245 | 4/1973 | Critcher | 114/61 |
| 3,790,977 | 2/1974 | Bombardier et al. | 114/357 |
| 3,815,541 | 6/1974 | Hansen | 114/259 |
| 4,287,624 | 9/1981 | Lowther | 114/123 |
| 4,598,659 | 7/1986 | Chinnery | 114/123 |

*Primary Examiner*—Joseph F. Peters, Jr.
*Assistant Examiner*—Stephen P. Avila
*Attorney, Agent, or Firm*—Eugene F. Friedman

[57] ABSTRACT

A safety cockpit for a powerboat totally separable from the remainder of the boat. The cockpit has a single wall between the interior and the exterior formed of a sandwich material of an Airex rigid foam to which are epoxied, on either side, two layers of Kevlar polyamide cloth. The removable cockpit section may extend only a portion of the length of the boat. In this instance, the boat then also includes two sponsons attached together to form a permanent deck; the cockpit then sits in a cavity formed between the sponsons in front of the deck. Alternately, the cockpit section may extend the entire length of the boat. In this case, a sponson attaches to each side of the nose section. The nose section also will then hold the engine powering the boat. In either event, the cockpit and the remainder of the boat only adjoin and connect to each other along vertical walls of each. The boat may use either hydraulic or cable connections to translate the manipulation of the controls in the cockpit to changes in the engine's orientation. Lastly, the engine may attach to a bar journalled to the vertical walls of the powerboat to eliminate the usual transom.

27 Claims, 2 Drawing Sheets

SAFETY COCKPIT FOR POWERBOAT

BACKGROUND

Powerboats, without doubt, expose their drivers to a very substantial risk of injury or worse. Any untoward incidents occurring at the high speeds at which such boats travel can seriously jeopardize the driver's physical well being. For example, a collision with a stationary object in the water or with another boat could well cause serious injuries to the driver.

To minimize the probability of such a deleterious occurrence, powerboat manufacturers have attempted to provide some degree of protection for the driver. In particular, some have built safety shields within the cockpit to provide some resistance to collision for the driver. Thus, many cockpits of powerboats will include, inside, a shell of a relatively hard material that will reduce collapsing of the boat's nose in the immediate vicinity of the driver in a collision.

However, incorporating the additional safety shield involves an extra step in the manufacture of the boat itself. This increases the coat of the boat as well as the time required to complete the building of the boat.

Further, the shield represents an additional component of the boat and itself possesses substantial weight. Thus, incorporating the shield into the boat increases the overall weight of the vehicle. In powerboats, the additional weight will result in a slower speed and thus a disdvantage in the competition for which the boat is built.

Additionally, mishaps do occur with powerboats. The damage suffered during such accidents by a boat may involve not only the exterior skin but also the safety shell of the cockpit itself. Accordingly, repairing the boat will require additional operations to ameliorate the condition of the safety shell as well as the external skin. Furthermore, obtaining access to the safety shell may require purposely damaging the external skin in order to obtain a sufficient opening to the cockpit shell. Accordingly, for all of these reasons, the search for an improved powerboat that will protect its driver continues.

SUMMARY

A powerboat will incorporate an improved cockpit for its driver when it forms a totally separable portion of the boat itself. This permits the utilization, in the construction of the outer shell and cockpit of a material designed for the protection of the driver. Yet, it permits the use of more conventional materials for the remainder of the boat including, where employed, the floatation section or sponsons. The removable nose section may simply constitute a capsule attached to the remainder of the boat which then forms a single solid unit. Alternately, the nose section may run the entire length of the boat, and the sponsons may attach to each side of the nose section.

A power boat with a separable nose section includes first a float section. This portion of the boat includes means for supporting the boat on the surface of a body of water. In a catamaran type powerboat, the float section will include two sponsons, with one lying on either side of the cockpit, or nose section.

As an additional separate component, the power boat includes the nose section. This portion of the boat includes, first, an outer shell, the bottom of which comes close to making contact with the water. Second, the nose section includes a cockpit which holds the driver of the boat. Lastly, the nose includes manipulatable controls within the cockpit for controlling the operation of the boat. Naturally, to allow the power boat to operate correctly, the nose section should be connectable to and removable from the float section.

Lastly, the powerboat must have an affixing device which couples to both the nose and float section. This permits the rigid, but yet removable, connecting together of the nose and float sections. Naturally, it also permits the removal of the nose section from the float section. Typically, the affixing device will serve to adhere vertical walls of the nose section to vertical walls of the float section.

As a separate aspect, an improved powerboat results where the protective barrier for the driver also represents the outer shell of the nose section. In this situation, the float and nose sections may not even necessarily disconnect from each other. However, where at least part of the surface of the interior of the cockpit also constitutes the outer shell of the nose section, the driver receives the desired protection. At the same time, the unified construction saves substantial weight by not requiring additional layers for the external skin and the inner cockpit shell of the nose section.

Furthermore, for both configurations of the removable nose section running either part or the entire length of the boat, the cockpit always remains rigged. The nose section with the cockpit may move to other float sections. However, the steering wheel, pedals, seat, and the other controls remain in the cockpit; the unit a a whole may transfer to another boat. With regards to the entire length nose section, the entire rigging system and the engine mount remain permanent; all of it forms part of the central removable portion of the boat and thus need not undergo disconnection and reattachment when attaching other sponsons to it.

Additionally, the removable nose section reduces the expense involved in manufacturing or purchasing a new boat. In the case of the partial nose section, a purchaser can simply remove it from one boat and attach it to a new boat. He has avoided the expense of obtaining a new nose section with its expensive cockpit and controls. For the nose section which runs the entire length of the boat, obtaining a new boat merely involves purchasing new sponsons.

If a driver has an accident during the testing and prerace activities, and the only damaged parts represent the float section or the sponsons, he can readily replace these and engage in the race. A single, unit-construction boat could well suffer sufficient damage to prohibit its racing at that time.

More particularly, during the race, a driver can change damaged sponsons on his boat. The rules permit this exchange. However, the driver cannot change boats. Thus, the changeable nose section allows the driver to continue in the race even after suffering damage; with a unit construction boat, he would lose his opportunity entirely for the race.

Furthermore, the construction material of Kevlar fabric sandwiched onto Airex foam provides stronger construction than previously used materials. Thus, the boat will less likely suffer damage and the driver will have greater security.

DETAILED DESCRIPTION

Figure 1:
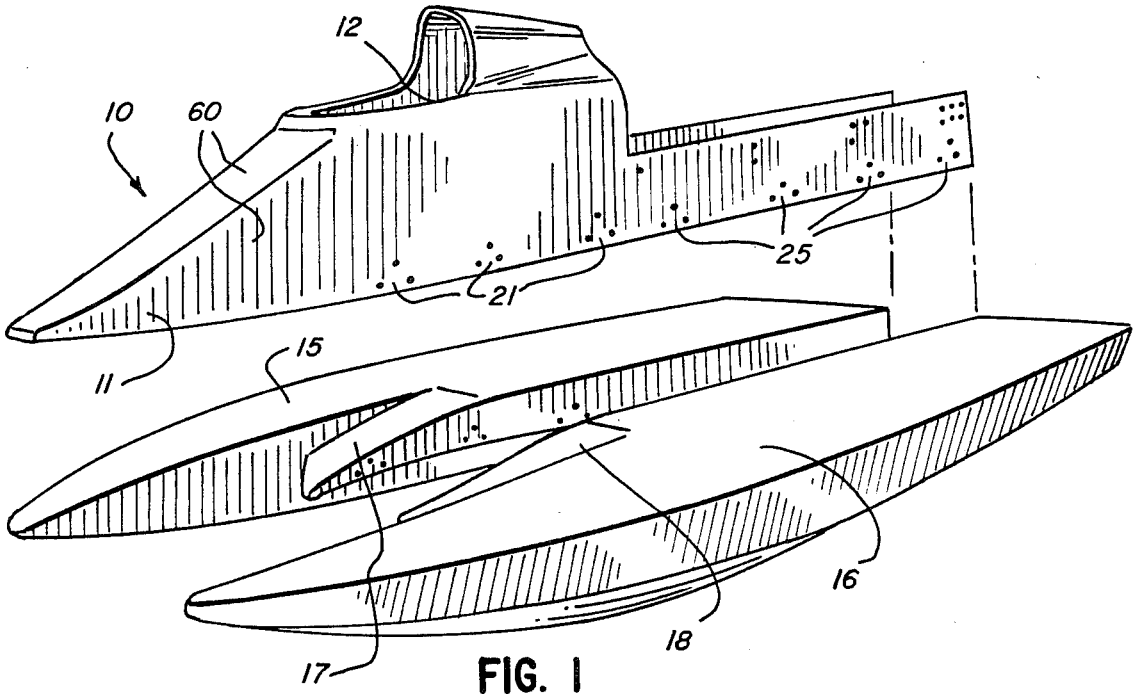
FIG. 1 gives a perspective view of a powerboat having a nose section running the entire length of the boat and removable from its two supporting sponsons.
Figure 2:
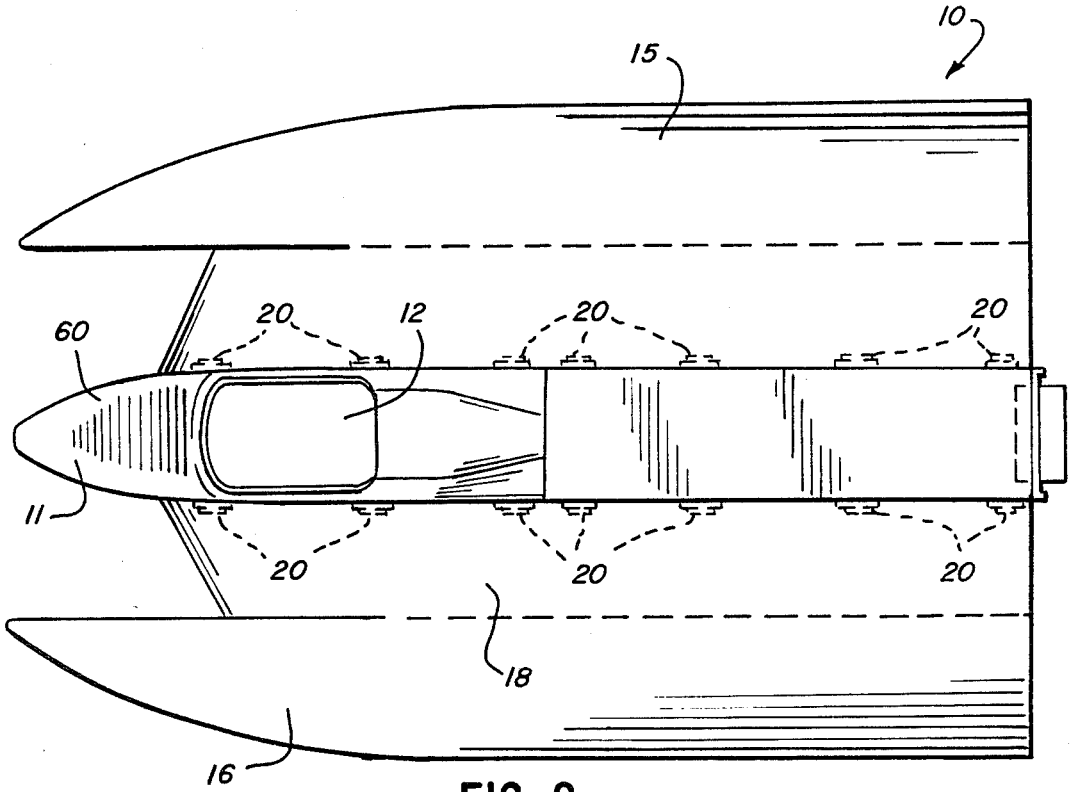
FIG. 2 provides a top plan view of the powerboat of FIG. 1 having a removable nose section running the entire length of the boat and with sponsons attached to the nose section.

FIGS. 1 and 2 show a powerboat generally at 10 having a nose section 11 that runs the entire length of the boat 10. The cockpit 12, of course, forms part of the removable nose section 11. The cockpit 12 includes the seat and safety belts for the driver as well as the usual controls including the steering wheel, brakes, throttle, and the usual switch panel.

Figure 3:
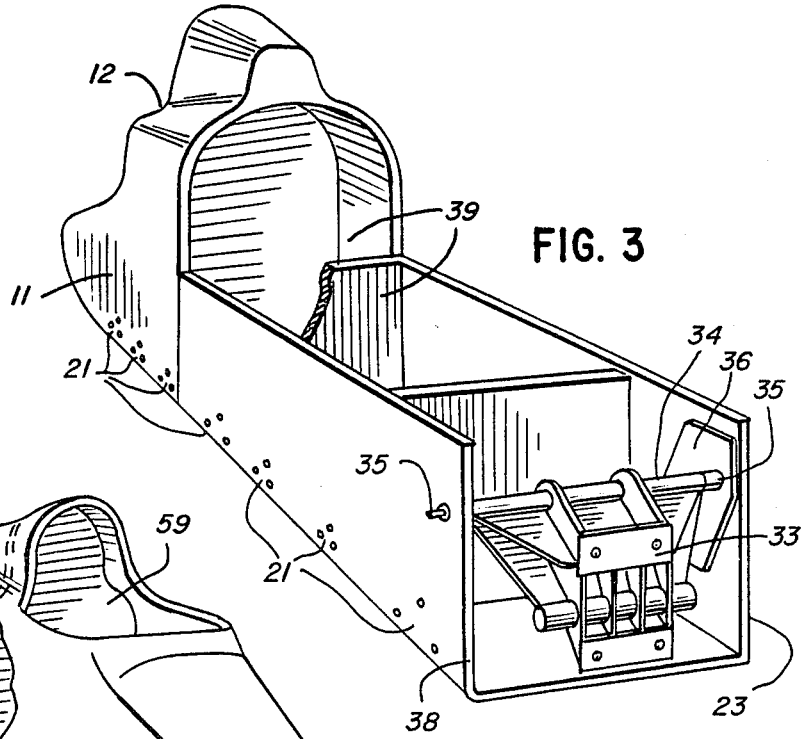
FIG. 3 displays a perspective view from the rear of the removable nose section of the boat of FIG. 1.

Additionally, the boat 10 includes the float section composed of the two sponsons 15 and 16 with their attached tunnels 17 and 18, respectively. The connections 20 affix the tunnels 17 and 18, and thus the sponsons 15 and 16, respectively, to the nose section 11. The openings 21 on the nose section 11 in FIG. 1 show where the bolts for the connectors 20 pass. As seen in FIGS. 1 to 3, seven connectors on each side hold the sponsons 15 and 16 to the nose section 11. While this does not represent an inflexible number, it does serve to adequately hold the boat together for the stresses that it will typically encounter.

Figure 4:
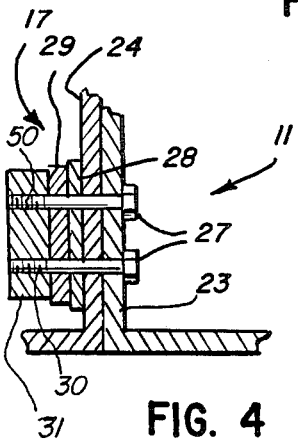
FIG. 4 provides a cross-sectional view along the lines 4—4 of FIGS. 2 and 5 showing one of the connection points between a removable nose section of a powerboat and a sponson.

The nature of the connectors 20 appears more clearly in FIG. 4. Specifically, the connector 20 couples together the vertical wall 23 of the nose section 11 to the vertical wall 24 of the tunnel 17. In particular, the bolts 27 pass through the wall 23, the wall 24, the two layers of wood 28 and 29 and into the tapped holes 30 of the steel plate 31. The supporting wood sections 28 and 29 and the steel plate 31, through the action of the bolts 27, serve to distribute the stress of holding the boat together.

Lastly, in FIG. 3, the rear of the nose section 11 includes the support structure 33 which holds the actual engine providing the motive force for the boat 10. The bar 34 journalled at the bearings 35 attach the supporting structure 33 to the nose section 11. The steel plate 36 provides additional support to the vertical wall 23 for the rod 34. A similar plate attached to the inside of the wall 38 helps support the bearing 35 on the left side of the nose section 11.

Should a serious accident occur, the two sponsons 15 and 17 may break away from the nose section 11. In that eventuality, the nose section, which runs the entire length of the boat, would continue to have the engine attached to the supporting section 33. The engine in turn would provide a counterweight to hold down the rear end of the nose section 11 and keep the front end projected upwards and above the water. This has the beneficial effect of keeping the driver above water.

To aid in the floatation of the nose section, especially its forward portion, the nose section 11 may also include air bags in the deck 39 behind the cockpit 12 to aid in the buoyancy. This should help assure that the nose section 11 will remain floating which will serve primarily to keep the driver out of the water. It also has the secondary beneficial effect of keeping the engine from sinking. This avoids the undesirable necessity of purchasing a new engine at a substantial cost.

The use of the removable nose section running the entire length of the powerboat permits the facile changing of sponsons for different race conditions. Thus, the driver may employ low sponsons for smooth water. However, should he find himself racing in rough water, he can remove the low sponsons and bolt into place on either side of the nose section 11 high sponsons which can handle the rougher water.

Figure 5:
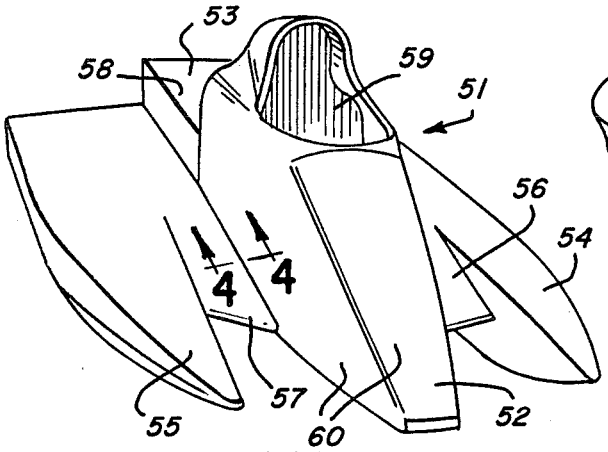
FIG. 5 gives a perspective view from the front of a powerboat having a removable nose capsule running less than the entire length of the boat and with sponsons permanently attached to a bridging deck at the rear of the removable capsule.
Figure 6:
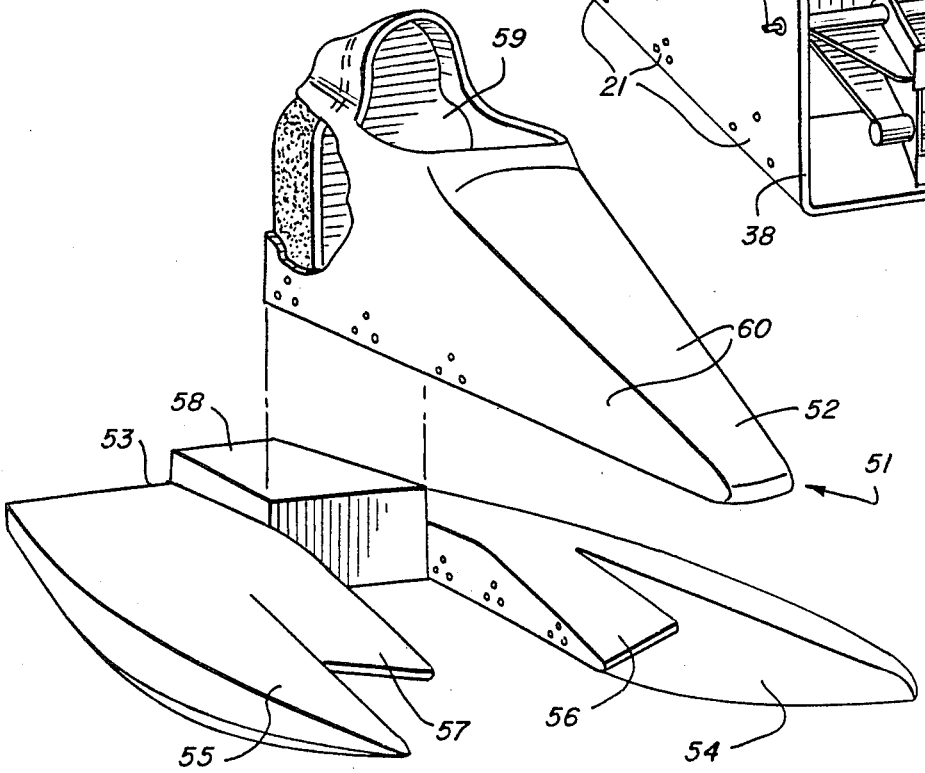
FIG. 6 gives a perspective view from the front of the boat of FIG. 5 showing the nose section removed from the remainder of the boat.

FIGS. 5 and 6 show a powerboat generally at 51 with a removable nose section 52 which extends only part of the length of the boat 51. The remainder of the boat constitutes the float section 53 which includes the sponsons 54 and 55 and their attached tunnels 56 and 57, respectively. The rear deck 58 permanently affixes to the tunnels 56 and 57 to form a solid unit with the sponsons 54 and 55 and the tunnels 56 and 57.

The nose section 52 includes the cockpit 59 in which the driver sits. The controls for the boat 51 also rest within the cockpit 59.

The nose sections 11 and 52 of the boats 10 and 51 employ a single layer of skin or material 63 between the inside of the cockpits 12 and 59 and the outside of the boats. The layer 60 thus forms the protective shell of the safety cockpits 12 and 59 as well as the cowlings on the outside of the nose sections 11 and 52.

Figure 7:
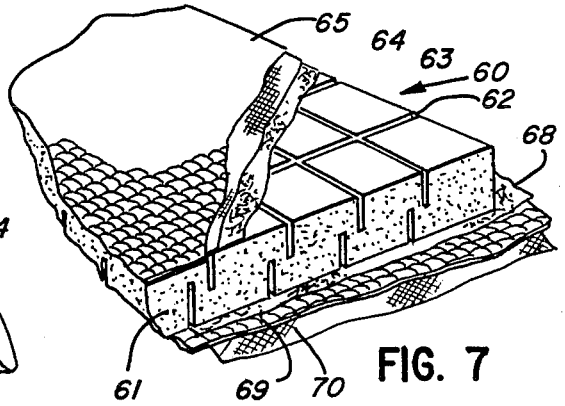
FIG. 7 shows, partly in cross-section, a sandwich of Airex foam and Kevlar fabric used for the surface of the removable nose section of the boat of FIGS. 1 to 6.

The structure of the skin or cowling 60 appears in exaggerated snd schematic detail in FIG. 7. As seen there, the skin 60 has an inner core of cross-linked polyvinylchloride Airex foam 61 manufactured by The Airex Company of Switzerland. The foam has a density of about 55 to 60 kilograms per cubic meter and is described in U.S. Pat. No. 3,867,238. The Airex foam 61 initially has a sufficiently pliable structure that it can undergo shaping into the desired configuration. The striations 62 aid in this pliability.

As seen in FIG. 7, the mat of fiberglass 63 sits on top of the Airex foam 61. On top of that lies two layers 64 and 65 of cloth, woven in checkerboard fashion, from Kevlar aromatic polyamide from E. I. du Pont de Nemours & Co. of Wilmington, Del., and having about 400 grams per square meter. An epoxy resin, sold under the designation of XB3052 by the Ciba-Geigy Company of Switzerland bonds the layers 63 and 65 to the foam 61. Similarly, the fiberglass mat 68 and the two layers 69 and 70 of Kevlar fabric adhere to the bottom side of the foam 61 with an epoxy resin.

The bonding of the Kevlar fabric to the Airex foam provides a rigid and sturdy structure. Yet, it has the resiliency to absorb moderate impacts without suffering damage. The epoxy which bonds the Kevlar to the Airex apparently fills in some of the pores of the Airex including portions of the striation 62 to impart the desired rigidity. The sandwich structure shown in FIG. 7 forms the cowling 63 which also constitutes the inner shell of the cockpit. It possesses minimal weight and thus helps to reduce the overall weight of the powerboat of which it forms part.

The production of the safety shells of the nose sections 11 and 52 to have the structure shown in FIG. 7 proceeds through the forming of two half shells divided along the center line of the nose sections. To begin the preparation of the half shells, the Airex foam, after being placed in a mold undergoes heating to 100° C. in an oven. Then, after being placed in a mold a vacuum applied to the mold results in the Airex adopting the shape of the half shell. The Airex stays in the vacuum for about one minute.

After the Airex foam cools, it receives two layers of the Kevlar and the fiberglass with the epoxy on its top surface. This is accomplished by first placing the fiberglass with the epoxy and then the Kevlar in the mold followed by the prefabricated Airex foam. The combination then stays in place overnight at room temperature. Then, the Airex (which now has one side covered with the two layers of Kevlar and the fiberglass) receives the fiberglass and the two layers of Kevlar with epoxy on its lower surface in the same fashion as for the upper surface described above. With the new fiberglass, the two layers of Kevlar, and the epoxy, the structure again remains overnight in a mold.

At this point, the two half shells will join together to form the nose section and cockpit. The amount of Kevlar used will prove sufficient for the entire nose section. However, the foam for each half shell only extends to within about one inch of the center line. Accordingly, to complete the construction involves placing an additional strip of Airex between the two half shells, bonding it to the two half shells with epoxy, and then attaching the fiberglass and the Kevlar from the two half shells with additional epoxy. When dry and completed, the nose sections may then receive its layers of paint prior to racing.

Accordingly, what is claimed is:

1. A powerboat comprising:

(A) a float section including means for supporting said boat on the surface of a body of water;

(B) a substantially nonnavigable nose section with (1) an outer shell, the bottom of which comes close to making contact with the water in which said boat is placed; (2) a cockpit for holding the driver of said boat; and (3) manipulatable controls within said cockpit for controlling the operation of said boat, said nose section being connectable to and removable from said float section; and (C) affixing means, coupled to said nose and float sections, for removably and rigidly connecting said nose and float sections together.

2. The boat of claim 1 wherein said affixing means connects together substantially vertical walls of said nose and float sections.

3. The boat of claim 2 wherein said nose and float sections make contact with each other only along substantially vertical walls.

4. The boat of claim 2 wherein said outer shell also forms the inner wall of at least part of said cockpit.

5. The boat of claim 4 wherein said nose section extends less than the entire length of said boat.

6. The boat of claim 4 wherein said nose section extends the entire length of said boat and includes support means for holding an engine to said boat.

7. The boat of claim 6 wherein said float section includes two sponsons, separate from each other, removably affixed to said nose section, said nose section is elongated, and one of said sponsons is affixed to one side of said nose section and the other said sponson is affixed to the other side of said nose section.

8. The boat of claim 7 wherein said outer shell provides the streamlining for said nose section and is resistant to crushing to provide protection for the driver of said boat.

9. A powerboat comprising:

(A) a float section including (1) a plurality of sponsons, (2) a deck section extending between and substantially permanently affixed to said sponsons, said sponsons and said deck section having a cavity into which said nose section fits, and (3) support means, coupled to said deck section, for holding an engine to said boats;

(B) a nose section with (1) an outer shell, the bottom of which comes close to making contact with the water in which said boat is placed; (2) a cockpit for holding the driver of said boat; and (3) manipulatable controls within said cockpit for controlling the operation of said boat, said nose section being connectable to and removable from said float section; and (C) affixing means, coupled to said nose and float sections, for removably and rigidly connecting said nose and float sections together.

10. The boat of claim 9 wherein said outer shell provides the streamlining for said nose section and is resistant to crushing to provide protection for the driver of said boat.

11. The boat of claim 10 wherein said support means includes (1) a rigid bar permanently journalled to vertical walls in said deck section and (2) holding means, permanently affixed to said bar, for attaching an engine to said boat.

12. The boat of claim 11 wherein said outer shell comprises a multilayer section of material of substantially rigid foam and fabric permanently adhered to both sides of said foam by an adhesive.

13. The boat of claim 12 further including hydraulic means, coupled between said manipulatable controls and an engine attached to said support means, for controlling the orientation of said engine relative to said boat in response to manipulation of said controls.

14. The boat of claim 12 further including cables coupled between said manipulatable controls and an engine attached to said support means for controlling the orientation of said engine relative to said boat in response to manipulation of said controls.

15. The boat of claim 12 wherein said nose section is elongated and said affixing means connects said nose and float sections at at least three locations on each side of said nose means.

16. The boat of claim 12 wherein said foam is a polyvinylchloride and said fabric is a polyamide.

17. A powerboat comprising:

(A) a float section including means for supporting said boat on the surface of a body of water;

(B) a nose extending substantially the entire length of said boat having (a) an outer shell, the bottom of which comes close to making contact with the water in which said boat is placed; (b) a cockpit for holding the driver of said boat; (c) manipulatable controls within said cockpit for controlling the operation of said boat, said nose section being connectable to and removable from said float section, and (d) support means for holding an engine to said boat, said support means including (1) a rigid bar permanently journalled to vertical walls in said nose section and (2) holding means, permanently affixed to said bar, for attaching an engine to said boat; and (C) affixing means, coupled to said nose and float sections, for removably and rigidly connecting said nose and float sections together.

18. The boat of claim 17 wherein said outer shell comprises a multilayer section of material of substantially rigid foam and fabric permanently adhered to both sides of said foam by an adhesive.

19. The boat of claim 18 wherein including hydraulic means, coupled between said manipulatable controls and an engine attached to said support means, for controlling the orientation of said engine relative to said boat in response to manipulation of said controls.

20. The boat of claim 18 further including cables coupled between said manipulatable controls and an engine attached to said support means for controlling the orientation of an engine relative to said boat in response to manipulation of said controls.

21. The boat of claim 18 wherein affixing means connects each of said sponsons to said nose section at at least seven locations along one side of said nose section.

22. The boat of claim 18 wherein said foam is a polyvinylchloride and said fabric is a polyamide.

23. A powerboat comprising:

(A) a float section including means for supporting said boat on the surface of a body of water;

(B) a substantially nonnavigable nose section with (1) an outer shell, the bottom of which comes close to making contact with the water in which said boat is placed; and (2) a cockpit for holding the driver of said boat, at least part of the surface of the interior of said cockpit being formed from said outer shell; and (3) manipulatable controls within said cockpit for controlling the operation of said boat.

24. A powerboat comprising:

(A) a float section including means for supporting said boat on the surface of a body of water;

(B) a nose section with (1) an outer shell, the bottom of which comes close to making contact with the water in which said boat is placed and also forms the inner wall of substantially all of said cockpit except for the rearmost wall of said cockpit; (2) a cockpit for holding the driver of said boat, at least part of the surface of the interior of said cockpit being formed from said outer shell; and (3) manipulatable controls within said cockpit for controlling the operation of said boat.

25. The boat of claim 24 wherein said outer shell provides the streamlining for said nose section and is resistant to crushing to provide protection for the cockpit of said boat.

26. The boat of claim 24 wherein said outer shell comprises a multilayer section of material of substantially rigid foam and fabric permanently adhered to both sides of said foam by an adhesive.

27. The boat of claim 26 wherein said foam is a polyvinylchloride and said fabric is a polyamide.

* * * * *